US005549051A

United States Patent [19]

Zimmerman

[11] Patent Number: 5,549,051

[45] Date of Patent: Aug. 27, 1996

[54] THREE PIECE HINGE TYPE DROP-LEAF SUPPORT

[76] Inventor: Harvey Zimmerman, 19 Eldorado Dr., East Northport, N.Y. 11731

[21] Appl. No.: 383,794

[22] Filed: Feb. 6, 1995

[51] Int. Cl.[6] ..... A47B 1/04

[52] U.S. Cl. ..... 108/81; 108/80; 16/348; 292/338

[58] Field of Search ..... 16/348, 360; 108/77, 108/80, 81, 82; 292/338, DIG. 17

[56] References Cited

U.S. PATENT DOCUMENTS

| | | | |
|---|---|---|---|
| 188,414 | 3/1877 | Rhode | 108/80 |
| 197,022 | 11/1877 | Eberhart | 108/81 |
| 1,902,175 | 3/1933 | Luric | 16/341 |
| 1,933,164 | 10/1933 | Corporon . | |
| 2,872,260 | 2/1959 | Walter | 108/81 |
| 2,883,249 | 4/1959 | Batson | 108/81 X |
| 2,902,326 | 9/1959 | Zimmerman | 108/81 |
| 2,943,896 | 7/1960 | Gaston . | |
| 3,672,312 | 6/1972 | Pettit et al. . | |
| 4,378,107 | 3/1983 | Wagster et al. . | |

*Primary Examiner*—Peter M. Cuomo
*Assistant Examiner*—Janet M. Wilkens
*Attorney, Agent, or Firm*—Galgano & Burke

[57] ABSTRACT

A hinge type drop-leaf support includes a table hinge plate, a leaf hinge plate, and a slotted strut. Both the table hinge plate and the leaf hinge plate are hingedly coupled to each other and each are provided with respective depending legs. One end of the strut is hingedly coupled to table hinge plate leg and the other end of the strut is provided with an L-shaped slot. The leaf hinge plate leg is provided with a pin which engages the L-shaped slot. The L-shaped slot and the depending legs are dimensioned so that the use of a detent is obviated. If desired, a coil spring may be provided at the hinged coupling of the strut and the table hinge plate leg to bias the strut in a downward direction. The L-shaped slot has a long portion and a short portion which form an angle between them which is preferably acute. When the leaf is raised, the pin on the leaf hinge plate leg moves through the long portion of the slot to the short portion of the slot where it is capture and prevented from moving back through the long portion of the slot. Moving the strut toward the leaf allows the pin the re-enter the long portion of the slot thereby allowing the leaf to drop.

15 Claims, 2 Drawing Sheets

THREE PIECE HINGE TYPE DROP-LEAF SUPPORT

BACKGROUND OF THE INVENTION

1. Field of the Invention

The invention relates to drop leaf supports. More particularly, the invention relates to a drop leaf support having an integral hinge.

2. State of the Art

Drop-leaf tables are well known in the art. These tables generally include a central rectangular portion which is supported by three or four legs and one or two leaf portions which are hingedly attached to the central rectangular portion. The leaf portions may be rectangular or semi-circular and are designed to assume two positions: a dropped position where the leaf hangs by a hinge approximately ninety degrees downward from the central portion, and a raised portion where the leaf is supported in a substantially coplanar relationship with the central portion. A collapsible supporting device is used to hold the leaf in the raised position.

Traditionally, the leaf supporting device and the leaf hinge were separate members. The leaf supporting device typically included a centrally hinged folding strut which was hingedly coupled to both the leaf and the central portion of the table. Raising the leaf caused the folding strut to open at its central hinge and a assume a generally collinear configuration. Various means, including springs, rods, and cams, were used to maintain the folding strut in its open supporting position. The leaf was lowered to the dropped position by folding the strut, often working against the spring, cam, or other device which was utilized to hold the strut open.

My prior U.S. Pat. No. 2,902,326 discloses a much improved support for a drop-leaf table which included an integral hinge. This hinge type drop-leaf support 10 is shown in prior art FIGS. 1 and 2 and generally includes five parts: two hinge plates 12, 14, a detent 20, a spring 22, and a slotted strut 26. The table hinge plate 12 is hingedly coupled to the leaf hinge plate 14. Both the table hinge plate 12 and the leaf hinge plate 14 are provided with respective depending legs 16, 18. The detent 20 is pivotally coupled to the leg 16 of the table hinge plate 12. The coil spring 22 biases the detent so that its first end 24 abuts the underside of the table hinge plate 12 when the leaf is raised as shown in prior art FIG. 2. The slotted strut 26 is hingedly coupled at one end 28 to the second end 30 of the detent 20. The slot 32 in the strut 26 has a concave portion 33 near its second end 34 and a rivet 36 in the leg 18 of the leaf hinge plate 14 engages the slot 32.

Prior art FIG. 1 shows the support 10 attached to a table 38 having a leaf 40 in the dropped position and prior art FIG. 2 shows the support in the open supporting position where the leaf 40 is raised relative to the table 38. From the foregoing description, it will be appreciated that when the leaf 40 is raised, the rivet 36 in the leg 18 of the leaf hinge plate 14 moves freely through the slot 32 in the strut 26. This causes the strut 26 to pivot relative to the detent 20 and causes the detent to pivot relative to the leg 16 of the table hinge plate 12. The strut 26 is dimensioned such that when the leaf 40 is raised to its substantially coplanar position with the table 38, the rivet 36 in the leg of the leaf hinge plate is aligned with the concave portion 33 of the slot 32. As the spring 22 biases the detent 20 to the position shown in prior art FIG. 2, the strut 26 is also held in a position where it is free to drop relative to the rivet 36. As the strut drops relative to the rivet, the rivet engages the concave portion 33 of the slot where it is prevented from sliding through the slot. Raising the leaf 40 may be accomplished with one hand by lifting the leaf until the strut 26 drops into the rivet engaging position shown in prior art FIG. 2. In order to lower the leaf, the strut is pressed upward toward the leaf 40 so that rivet 36 is again free to slide through the slot 32 in the strut under the action of gravity. To facilitate lowering of the leaf, the strut is provided with a finger flange 42.

While my hinge type drop-leaf support 10 shown in prior art FIGS. 1 and 2 is a great improvement over the more complex devices often used in drop-leaf tables, I have discovered a more improved hinge type drop-leaf support which is just as easy to use but which is simpler and less expensive to manufacture.

SUMMARY OF THE INVENTION

It is therefore an object of the invention to provide a drop-leaf support having an integral hinge.

It is also an object of the invention to provide a hinge type drop-leaf support which is inexpensive to manufacture.

It is another object of the invention to provide a hinge type drop-leaf support which is easy to use.

It is still another object of the invention to provide a hinge type drop-leaf support which is safe and reliable.

In accord with these objects which will be discussed in detail below, the hinge type drop-leaf support of the present invention includes a table hinge plate, a leaf hinge plate, and a slotted strut. Both the table hinge plate and the leaf hinge plate are hingedly coupled to each other and each are provided with respective depending legs. One end of the strut is hingedly coupled to table hinge plate leg and the other end of the strut is provided with an L-shaped slot. The leaf hinge plate leg is provided with a pin which engages the L-shaped slot. The L-shaped slot and the depending legs are dimensioned so that the use of a detent is obviated. If desired, a coil spring may be provided at the hinged coupling of the strut and the table hinge plate leg to bias the strut in a downward direction. The L-shaped slot has a long portion and a short portion which form an angle between them which is preferably acute. When the leaf is raised, the pin on the leaf hinge plate leg moves through the long portion of the slot to the short portion of the slot where it is capture and prevented from moving back through the long portion of the slot. Moving the strut toward the leaf allows the pin the re-enter the long portion of the slot thereby allowing the leaf to drop.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 2:
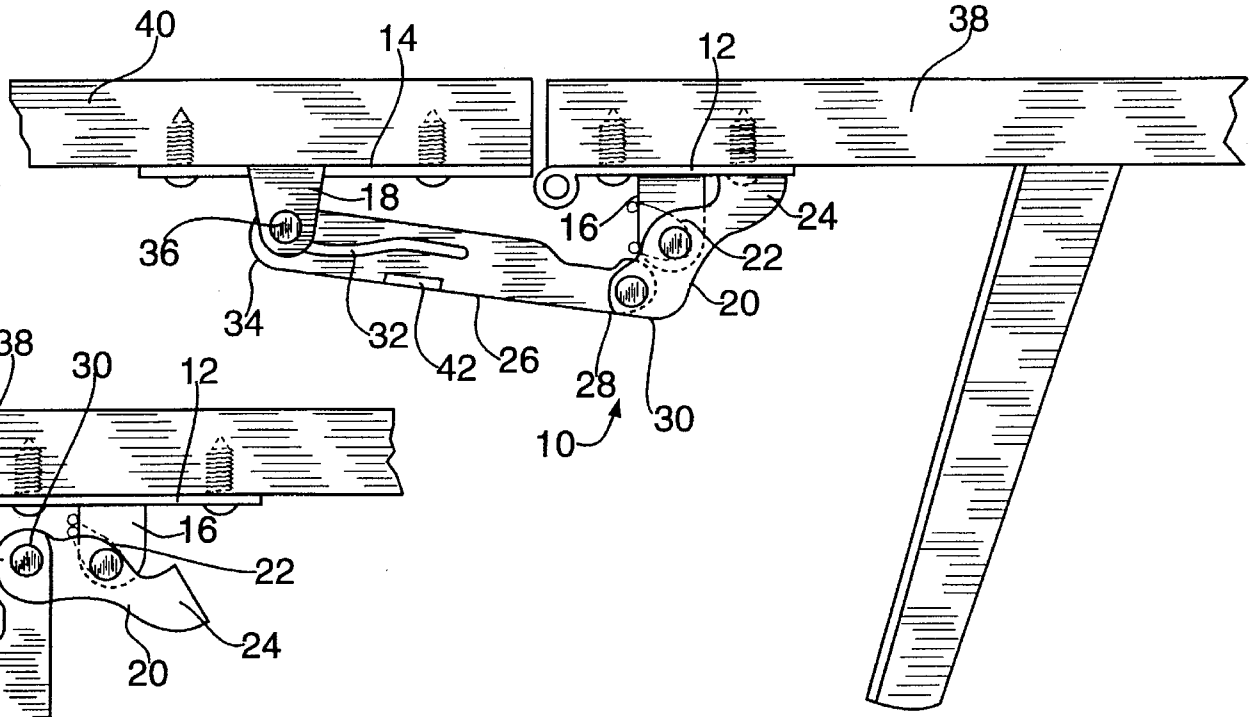
FIG. 2 PRIOR ART
FIG. 2 is a side elevational view of my prior art hinge type drop-leaf support in the raised position.
Figure 1:
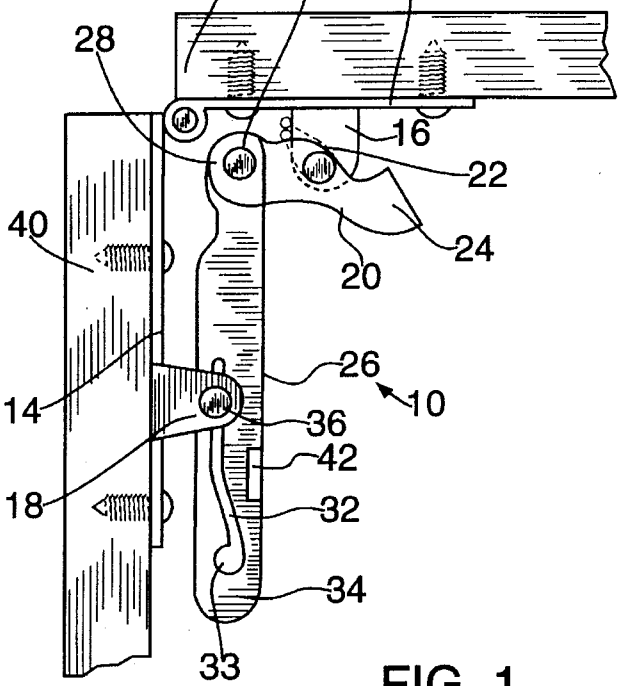
FIG. 1 is a side elevational view of my prior art hinge type drop-leaf support in the dropped position.
Figure 4:
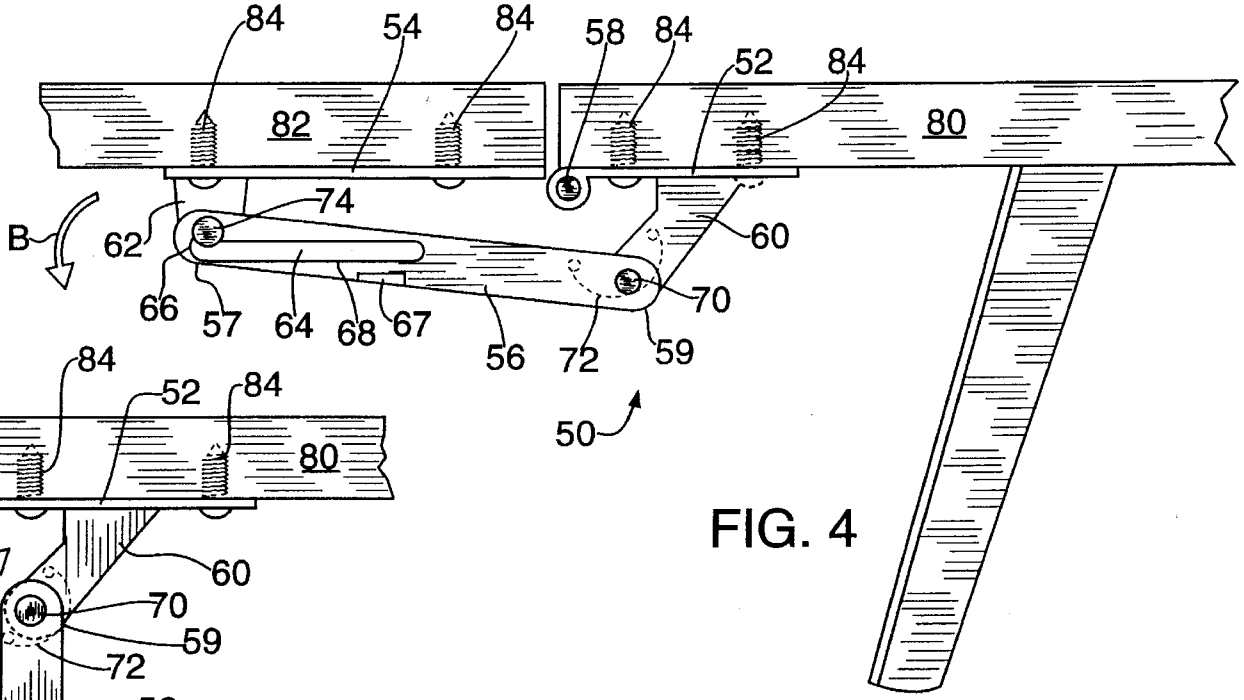
FIG. 4 is a view similar to FIG. 2 of a hinge type drop-leaf support according to the invention.
Figure 3:
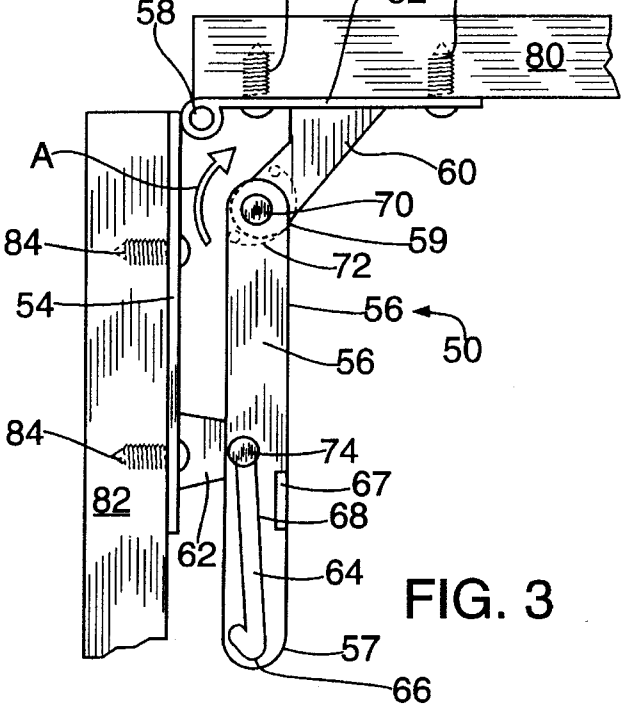
FIG. 3 is a view similar to FIG. 1 of a hinge type drop-leaf support according to the invention.

Referring now to FIG. 3 and 4, the hinge type drop-leaf support 50 according to the invention includes a table hinge plate 52, a leaf hinge plate 54, and a slotted strut 56. The table hinge plate 52 and the leaf hinge plate 54 are hingedly coupled to each other at 58. Both the table hinge plate 52 and the leaf hinge plate 54 are provided with respective depending legs 60, 62. The depending leg 60 on the table hinge plate 52 is longer than the depending leg 62 on the leaf hinge plate 54 and is inclined toward the hinge coupling 58. The leaf hinge plate 54 is longer than the table hinge plate 52 and its depending leg 62 is located at the point most distant from the hinge coupling 58.

The strut 56 has a first end 57 and a second end 59 and is provided with a substantially L-shaped slot 64 which extends approximately half way from the first end 57 to the second 59. The slot 64 has a first short portion 66 and a second long portion 68. The angle between the short portion and the long portion of the slot is preferably acute. The second end 59 of the strut 56 is hingedly coupled to the leg 60 of the table hinge plate 52 by a rivet, screw, pin, or the like 70. A coil spring 72 is preferably coupled to the leg 60 and the second end 59 of the strut 56 so as to bias the strut downward toward the position shown in FIG. 3. The strut 56 is coupled to the leg 62 of the leaf hinge plate 54 by a rivet, screw, pin, or the like 74 which engages the slot 64 in the strut.

The hinge type drop-leaf support 50 is coupled to a table 80 having a leaf 82 with screws 84 such that the hinge coupling 58 lies along the lower edges of the table 80 and the leaf 82. The support 50 is dimensioned such that when the leaf 82 is in the dropped position which is substantially perpendicular to the table 80 as shown in FIG. 3, the rivet 74 in the leg 62 is substantially at the end of the long portion 68 of the slot 64 in the strut 56; and, when the leaf 82 is in the raised position which is substantially coplanar with the table 80 as shown in FIG. 4, the rivet 74 engages the short portion 66 of the slot 64.

From the foregoing, those skilled in the art will appreciate that when the leaf 82 is raised, the rivet 74 in the leg 62 of the leaf hinge plate 54 moves freely through the long portion 68 of the slot 64 toward the short portion 66 of the slot. This causes the strut 56 to pivot about the rivet 70 relative to the leg 60 of the table hinge plate 52 in a first direction shown by arrow A. When the leaf 82 is raised to its substantially coplanar position with the table 80 as shown in FIG. 4, the rivet 74 in the leg of the leaf hinge plate is aligned with the short portion 66 of the slot 64. As the spring 72 and the action of gravity bias the strut 56 downward away from the leaf 82, the strut pivots about rivet 70 in a second direction shown by arrow B. This causes the first end 57 of the strut 56 to move downward relative to the rivet 74 so that the rivet 74 is captured in the short portion 66 of the slot 64. Since the angle between short portion 66 and the long portion 68 of the slot 64 is acute, the rivet 74 is prevented from entering the long portion 68 of the slot. The leaf is thereby supported by the strut until the strut is moved upward toward the leaf. Raising the leaf may be accomplished with one hand by lifting the leaf until the strut drops into the rivet engaging position shown in FIG. 4. In order to lower the leaf 82, the strut 56 is pressed upward toward the leaf so that rivet 74 is again free to slide through the long portion 68 of the slot 64 under the action of gravity. To facilitate lowering of the leaf, the strut is provided with a finger flange 67.

There has been described and illustrated herein hinge type drop-leaf support. While particular embodiments of the invention have been described, it is not intended that the invention be limited thereto, as it is intended that the invention be as broad in scope as the art will allow and that the specification be read likewise. Thus, while particular couplings such as rivets and screws have been disclosed, it will be appreciated that other types of couplings could be utilized. Also, while the slot in the strut has been shown to have a particular acute angle between its long and short portions, it will be recognized that other angles could be used with similar results obtained. Moreover, while the hinge plates have been describe as one being relatively larger than the other, the hinge plates could be the same size. Furthermore, while the hinge type drop-leaf support has been shown to be attached to a table and leaf with screws, it will be appreciated that other fastening means could also be used.

It will therefore be appreciated by those skilled in the art that yet other modifications could be made to the provided invention without deviating from its spirit and scope as so claimed.

I claim:

1. A three-piece hinge type drop-leaf support consisting essentially of:

a) a table hinge plate having a first depending leg;

b) a leaf hinge plate having a second depending leg and being hingedly coupled to said table hinge plate; and c) a strut having a first end, a second end, and a substantially L-shaped slot defined by a short portion and a long portion, said second end being directly hingedly coupled to said first depending leg, said second depending leg having slot engaging means for coupling said second depending leg to said substantially L-shaped slot, wherein when said leaf hinge plate is moved from a first position which is substantially perpendicular to said table hinge plate to a second position which is substantially coplanar with said table hinge plate, said slot engaging means moves through said long portion of said slot to said short portion of said slot, said strut pivots in a first direction relative to said first depending leg until said slot engaging means reaches said short portion of said slot whereupon said strut pivots in a second direction and said slot engaging means is captured by said short portion of said slot.

2. A support according to claim 1, wherein:

said first depending leg is inclined toward said leaf hinge plate.

3. A support according to claim 2, wherein:

said long portion of said slot and said short portion of said slot define an angle between them and said angle is less than or equal to 90°.

4. A support according to claim 3, wherein:

each of said short portion and said long portion are substantially linear.

5. A support according to claim 2, wherein:

said second depending leg is located on said leaf hinge plate at a point substantially most distant from said table hinge plate.

6. A three-piece hinge type drop-leaf support consisting essentially of:

a) a table hinge plate having a first depending leg;

b) a leaf hinge plate having a second depending leg and being hingedly coupled to said table hinge plate; and c) a strut having a first end, a second end, and a substantially L-shaped slot defined by a short portion and a long portion, said second end being directly hingedly coupled to said first depending leg, said second depending leg having slot engaging means for coupling said second depending leg to said substantially L-shaped slot, and biasing means coupled to said first depending leg and said strut for biasing said strut away from said leaf hinge plate, wherein when said leaf hinge plate is moved from a first position which is substantially perpendicular to said table hinge plate to a second position which is substantially coplanar with said table hinge plate, said slot engaging means moves through said long portion of said slot to said short portion of said slot, said strut pivots in a first direction relative to said first depending leg until said slot engaging means reaches said short portion of said slot whereupon said strut pivots in a second direction and said slot engaging means is captured by said short portion of said slot.

7. A support according to claim 6, wherein:

said biasing means is a coil spring.

8. A support according to claim 6, wherein:

said strut is provided with a finger flange such that when said leaf hinge plate is in said second position, pressing said finger flange toward said leaf hinge plate moves said strut in said first direction so that said slot engaging means is free to re-enter said long portion of said slot.

9. A three-piece hinge type drop-leaf support consisting essentially of:

a) a leaf hinge plate having a first depending leg;

b) a table hinge plate having a second depending leg and being hingedly coupled to said leaf hinge plate with said second depending leg being inclined toward said leaf hinge plate; and c) a strut having a first end, a second end, and a substantially L-shaped slot defined by a short portion and a long portion, said second end being hingedly coupled to said second depending leg, said first depending leg having slot engaging means for coupling said first depending leg to said substantially L-shaped slot, wherein when said leaf hinge plate is moved from a first position which is substantially perpendicular to said table hinge plate to a second position which is substantially coplanar with said table hinge plate, said slot engaging means moves through said long portion of said slot to said short portion of said slot, said strut pivots in a first direction relative to said second depending leg until said slot engaging means reaches said short portion of said slot whereupon said strut pivots in a second direction and said slot engaging means is captured by said short portion of said slot.

10. A support according to claim 9, wherein:

said long portion of said slot and said short portion of said slot define an angle between them and said angle is less than or equal to 90°.

11. A support according to claim 10, wherein:

said first depending leg is located on said leaf hinge plate at a point substantially most distant from said table hinge plate.

12. A support according to claim 10, wherein:

each of said short portion and said long portion are substantially linear.

13. A three-piece hinge type drop-leaf support consisting essentially of:

a) a leaf hinge plate having a first depending leg;

b) a table hinge plate having a second depending leg and being hingedly coupled to said leaf hinge plate with said second depending leg being inclined toward said leaf hinge plate; and c) a strut having a first end, a second end, and a substantially L-shaped slot defined by a short portion and a long portion, said second end being hingedly coupled to said second depending leg, said first depending leg having slot engaging means for coupling said first depending leg to said substantially L-shaped slot, and biasing means coupled to said second depending leg and said strut for biasing said strut away from said leaf hinge plate, whereby when said leaf hinge plate is moved from a first position which is substantially perpendicular to said table hinge plate to a second position which is substantially coplanar with said table hinge plate, said slot engaging means moves through said long portion of said slot to said short portion of said slot, said strut pivots in a first direction relative to said second depending leg until said slot engaging means reaches said short portion of said slot whereupon said strut pivots in a second direction and said slot engaging means is captured by said short portion of said slot.

14. A support according to claim 13, wherein:

said biasing means is a coil spring.

15. A support according to claim 13, wherein:

said strut is provided with a finger flange such that when said leaf hinge plate is in said second position, pressing said finger flange toward said leaf hinge plate moves said strut in said first direction so that said slot engaging means is free to re-enter said long portion of said slot.

* * * * *